United States Patent [19]

Riihinen

[11] 4,033,812

[45] July 5, 1977

[54] DEWATERING SYSTEMS FOR PAPER MACHINES

[75] Inventor: Kalevi Riihinen, Tampere, Finland

[73] Assignee: Valmet Oy, Finland

[22] Filed: Oct. 24, 1975

[21] Appl. No.: 625,670

[30] Foreign Application Priority Data

Oct. 25, 1974 Finland ..... 3138/74

[52] U.S. Cl. ..... 162/273; 162/301; 162/352

[51] Int. Cl.[2] ..... D21F 1/00

[58] Field of Search ..... 162/273, 301, 303, 307, 162/352, 364, 199, 203, 217

[56] References Cited

UNITED STATES PATENTS

| | | | |
|---|---|---|---|
| 2,730,933 | 1/1956 | Reynolds | 162/307 X |
| 3,262,841 | 7/1966 | Embry | 162/303 X |
| 3,623,945 | 11/1971 | Tommeraasen | 162/273 |
| 3,726,758 | 4/1973 | Parker et al. | 162/301 X |
| 3,772,145 | 11/1973 | Notbohm | 162/301 X |
| 3,846,233 | 11/1974 | Kankaanpaa | 162/301 X |

*Primary Examiner*—S. Leon Bashore
*Assistant Examiner*—Richard V. Fisher
*Attorney, Agent, or Firm*—Steinberg & Blake

[57] ABSTRACT

A paper machine which has a dewatering system accordng to which during web formation as dewatering progresses the dewatering pressure increases. The stock from a headbox is initially delivered to a single liquid-pervious web-carrying element. As the latter travels away from the headbox with the stock received therefrom it meets a web-pressing element which together with the web-carrying element forms a twin-wire type of construction with the web being compressed between these elements as they travel along a common path. While these elements travel along a common path they are guided by structure which provides for increasing pressure on the web between the elements so that as dewatering progresses the pressure on the web between the elements increases. In this way it is possible to avoid an initial undesirably violent dewatering of the web during an initial phase in the formation thereof. As the above elements travel along their common path the direction of travel thereof preferably is reversed. The web-carrying element is guided by structure supported on a stationary frame unit while the web-pressing element is guided by structure supported by a movable frame unit having a construction according to which the web-pressing element can easily be moved to and from its position cooperating with the web-carrying element.

2 Claims, 1 Drawing Figure

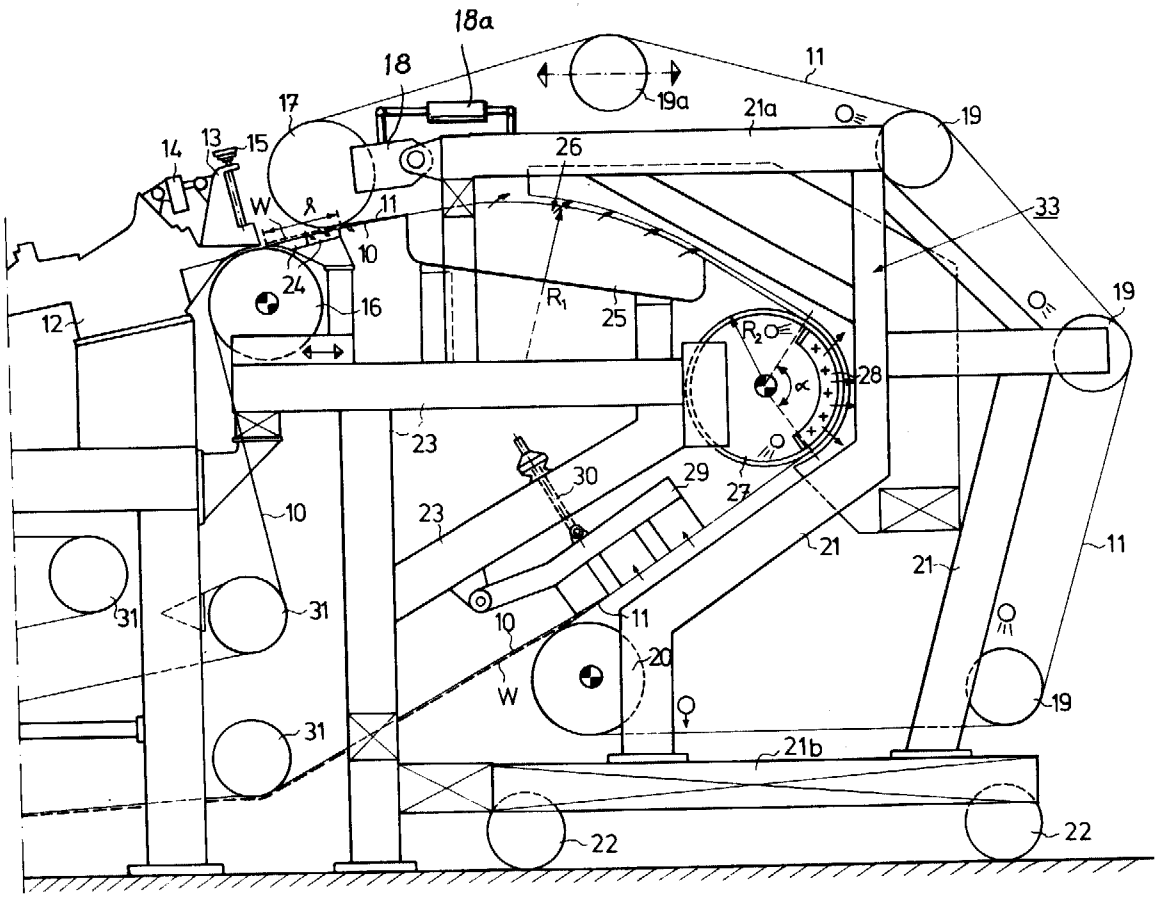
19
11
33
19
22
21
28
21
21a
21b
19a
27
29
20
25
26
30
10
W
18a
18
23
23
17
16
24
31
31
15
13
14
12
31

DEWATERING SYSTEMS FOR PAPER MACHINES

BACKGROUND OF THE INVENTION

The present invention relates to paper machines.

In particular, the present invention relates to a machine especially adapted for manufacturing a paper such as tissue paper. The web-forming part of the machine includes a web-carrying means in the form of a wire or felt on which pulp stock is supplied from a headbox. The path taken by the web-carrying means is determined by guide means which influence the dewatering action and which in addition provide for the web-carrying means a reversal in its direction of travel. A web-pressing means cooperates with the web-carrying means to form a twin-wire type of construction therewith, the web-pressing means also taking the form of a suitable wire or felt and the latter having with the web-carrying means a common path of ravel over a substantial portion of the path taken by the web-carrying means at the region where the path of travel of the latter is reversed.

It is known to manufacture paper such as tissue paper by forming the web on a comparatively short wire section which resembles a normal planar wire with the headbox supplying the stock onto a breast roll which frequently has a suitably recessed surface or which communicates with an internal source of vacuum, with the web travelling, while supported by the wire, past conventional dewatering elements such as table rolls, deflectors, foil strips, suction boxes and a suction roll, each of which serves to remove water from the stock web, although structures of this latter type have been omitted in certain instances with relatively new designs. After web formation has progressed to a certain degree, the partly dried web is transferred to a pick-up felt or the like, and while supported by the latter the web is subjected to further drying in the press and drying sections of the machine.

In order to simplify the machine and reduce the amount of space occupied thereby, in some designs the planar wire section has been omitted. With such a construction the formation of the web takes place on a breast roll which is totally wire-covered and from which the web is directly transferred to a pick-up felt.

In recent years there has been developed so-called twin-wire formers wherein formation of the paper web takes place between a pair of wires, in a manner differing from web formation by way of a Fourdrinier wire section. As a result of the efficient dewatering action achieved with twin-wire formers, the wire portion of the structure can be made much shorter and in many respects is more economical than a conventional Fourdrinier wire arrangement. However, twin-wire formers of this latter type have a serious drawback in that the stock is usually supplied into the throat formed between the wires as they converge toward each other. With this latter construction the stock is immediately subjected to a voilent dewatering action with this intense dewatering taking place simultaneously in a pair of opposed directions, through both wires, during formation of the web. Along with the violent extraction of water, large amounts of fine fibers and fillers also tend to escape, with the result that the web loses its softness and resilience. Inasmuch as these latter properties are important for tissue paper, these twin-wire formers have proved to be unsuitable for the manufacture of paper of this type.

SUMMARY OF THE INVENTION

It is accordingly a primary object of the present invention to provide a paper machine suitable for manufacture of paper such as tissue paper and capable of avoiding the drawbacks of the twin-wire formers as referred to above.

In particular, it is an object of the present invention to provide a machine capable of combining the advantages of a conventional Fourdrinier machine and a twin-wire type of former, while avoiding the above-mentioned drawbacks of the latter. Thus it is an object of the invention to provide a twin-wire type of machine which is particularly well suited for the manufacture of a paper such as tissue paper.

It is furthermore an object of the present invention to provide a machine where at its web-forming part the filtering pressure or dewatering pressure acting on the web can be relatively small at an initial stage of dewatering with this pressure increasing either continuously or in a stepwise manner as the water content of the web decreases. The filtering or dewatering pressure, of course, is understood to be the hydraulic pressure under which water is removed from the web. Thus, it is an object of the invention to provide a machine wherein the dewatering pressure is not excessive so as to avoid adherence of the web to a web-pressing wire or felt to an extent which is too great in consideration of detachment of the web from the web-pressing wire or felt so as to be carried beyond the latter by the web-carrying wire or felt.

Thus, it is an object of the present invention to provide a web-forming structure which is capable of giving to the final product the best possible softness and absorbency.

It is also an object of the present invention to provide for a machine of the above type a construction according to which use of the relatively expensive so-called Yankee cylinder can be omitted or at least may be reduced in size while retaining a fundamental operating principle according to which it is possible to achieve in the paper which is manufactured the softness and resilience which are required characteristics of tissue paper.

It is also an object of the present invention to provide a construction which will occupy a relatively small amount of space and which can be readily serviced, particularly in connection with procedures involved with changing of the wire or felt.

In order to achieve the above objects the invention is mainly characterized in that a relatively short initial part of the web-forming section is of the single-wire type, this initial part being formed by a wire or felt portion which is supported by foil-type or lath-type of dewatering elements, while in a subsequent twin-wire type of structure for the web-forming section there is within the loop of a web-carrying wire or felt first a curved-surface dewatering shoe which preferably has a closed cover and in the region of which water is extracted through the web-pressing wire or felt as a result of centrifugal force. Subsequent to this curved shoe there is within the loop of the web-carrying wire or felt a reversing roll having a radius substantially smaller than the average radius of curvature of the above curved shoe, and in the region of this reversing roll dewatering primarily takes place as a result of centrifugal force through the web-pressing wire or felt. At the end of the common path of travel of the twin-wire type of elements there is a transfer suction box or a set of such boxes, by means of which the web is detached from the web-pressing wire or felt and made to adhere to the web-carrying wire or felt with which the web is transported beyond the common path of travel of the twin-wire type of elements. From the starting location toward the ending location of the common path of travel of the liquid-pervious web-carrying means and web-pressing means, components such as the above curved shoe and reversing roll, which form part of a guide means for endless web-carrying and web-pressing means, bring about a pressure on the web, during formation thereof along this common path of travel, which increases as the extent of dewatering increases, with the dewatering pressure on the initially deposited stock received by the web-carrying means at its portion which travels toward the starting end of the above common path of travel being less than the dewatering pressure even at the initial part of the common path of travel of the web-carrying and web-pressing means.

BRIEF DESCRIPTION OF DRAWING

The invention is illustrated by way of example in the accompanying drawing which forms part of this application and in which one possible structure according to the present invention is shown in a schematic side elevation.

DESCRIPTION OF PREFERRED EMBODIMENTS

Referring to the drawing, there is illustrated threin a pair of elongated, endless, flexible, liquid-pervious means one of which is a web-carrying means 10 in the form of a suitable felt or wire and the other of which is a web-pressing means 11 also in the form of a suitable felt or wire. The structure shown in the drawing may be considered as the web-forming section of a tissue paper machine. The stock suspension is supplied onto the web-carrying wire or felt 10 by way of a headbox means 12 situated in part over a breast roll 16 which forms part of a guide means which guides the pair of means 10 and 11. The breast roll 16 is situated within the loop of the web-carrying means 10 and the stock which forms the web W is initially delivered from the headbox means 12 only onto the web-carrying means 10 at the part of the latter which is situated at the upper portion of the breast roll 16 and travels toward the right, as viewed in the drawing, as the breast roll 16 rotates in a clockwise direction, as viewed in the drawing. The headbox means 12 is a hydraulic headbox, preferably of the so-called lamellar type. The upper lip beam 13 of the headbox 12 is capable of being adjusted by way of the coarse adjusting structure 14 and the fine adjusting structure 15 which takes the form of suitable adjusting spindles which are capable of adjusting the lip slice.

A stationary frame means 23 serves to carry that part of the guide means which guides the endless web-carrying means 10 so that the latter forms a loop which is partially illustrated in the drawing. The frame means 23 supports not only the breast roll 16 for rotary movement but also a number of components which form part of the guide means for the web-carrying means 10, these components including, in the direction of travel of the wire or felt 10 starting at the headbox, the foil-type or lath-type of dewatering and supporting members 24, situated immediately subsequent to the breast roll 16, the dewatering shoe 25 which has an upper convexly curved dewatering surface preferably formed by a closed cover 26, the reversing roll 27 provided in its interior with a chamber 28 the interior of which is at greater than atmospheric pressure, and the transfer means formed by the suction box assembly 29, serving to effect reliable transfer of the web W to the wire or felt 10 to be carried by the latter beyond the pressure wire or felt 11, with an adjusting means 30 being carried by the frame means 23 and operatively connected to the transfer means 29 for adjusting the latter in the manner which is clearly apparent from the drawing. The guide means for the wire or felt 10 includes not only the latter components but also a number of guide rolls 31.

The part of the guide means which guides the endless web-pressing wire or felt 11 is carried by a movable frame means 33 in the form of a carriage having an open portion of substantially U-shaped configuration for receiving the reversing roll 27 and the part of the wire or felt 10 extending to the left from the reversing roll 27, as viewed in the drawing, both above and below the reversing roll 27. Thus, the part of the wire or felt 10 which projects to the right, as viewed in the drawing, from the headbox 12 to the reversing roll 27 and then to the left from the latter is capable of being received in the throat-like U-shaped portion of the movable frame means or carriage 33. This carriage 33 has at its lower part wheels 22 as well as a frame portion 21 which supports for rotary movement a pair of reversing rolls 17 and 20 for the web-pressing wire or felt 11. In addition, the movable frame means 33 supports by way of its frame struction 21 a number of guide rolls 19 which serve in addition to the reversing rolls 17 and 20 to support and guide the endless web-pressing means 11. The movable frame structure 21 has at its lower part horizontal beams **21*b* which are directly connected to the wheels 22 so as to support the latter for rotation, and the upper part of the movable frame structure 21 is provided with horizontal beams 21*a* which are pivotally connected at one end to swingable arms 18 which carry the upper reversing roll 17 of the web-pressing means 11 and which are operatively connected to a power means 18*a*, in the form of a suitable hydraulic piston-and-cylinder assembly, for example, so that by way of the means 18, 18*a* it is possible to raise and lower the upper reversing roll 17 of the web-pressing means 11. When this roll 17 is thus raised to an elevation higher than illustrated in the drawing, the carriage 33 can be pushed to the left, as viewed in the drawing, into its operating position or it can be advanced to the right, as viewed in the drawing, to be withdrawn from the operating position illustrated, for purposes such as, for example, wire or felt changing. The guide means includes an uppermost guiding roll 19*a* which is capable of having its position adjusted, as indicated by the dot-dash double-headed arrow, so as to adjust the tension of the pressing wire or felt 11. The carriage 33** of course provided with securing means for securing the carriage in the position illustrated in the drawing.

As is apparent from the above description, the web-carrying means 10 can take the form of a suitable wire or a corresponding felt may be used. In this latter event there will be no downward dewatering at the initial part of the web.

As is apparent from the drawing, the initial part of the forming section is of the single-wire type, at the region where the foil-type or lath-type of dewatering means 24 is situated. Thus, at this region there is a relatively short length $\lambda$ of a single-wire type of support for the stock received from the headbox means 12, this single-wire type of run extending from the crest of the breast roll 16 to the starting location of the common path of travel of the pair of means 10 and 11. At this initial part of the web-forming phase where the stock is supported only by the web-carrying means 10, dewatering takes place through the carrying wire 10 primarily by gravity, and under all circumstances, this initial dewatering action is a relatively gentle, cautious dewatering taking place with a relatively small dewatering or filtering pressure as compared with the situation where in the prior art the stock issuing from the headbox is immediately situated under powerful pressure between a pair of wires.

After the web W has thus been supported through a predetermined distance by a single-wire type of support, it becomes sandwiched under pressure between the pair of means 10 and 11, which may take the form of a pair of wires or which may take the form of a wire 10 and a felt 11, although the means 10 also may take the form of a felt, so that from the starting location of the common path of travel of the pair of means 10 and 11 the extent of dewatering of the web increases. The common path of travel of the pair of means such as wires 10 and 11 is determined subsequent to the starting location just beneath the reversing roll 17 by way of the curved shoe 25 which has an upper closed cover 26 formed with a convexly curved surface by means of which the web W is subjectd to centrifugal force. As a result of this centrifugal force water escapes upwardly through the covering or pressing wire or felt 11. The convexly curved surface of the cover 26 has a mean radius of curvature $R_1$. This radius of curvature is preferably such that it continuously decreases from that end of the shoe 25 which is nearest the starting location of the common path of travel of the pair of means 10 and 11 toward that end of the shoe 25 which is nearest the reversing roll 27. Thus, this radius of curvature of the upper surface of the cover 26 continuously decreases from the left toward the right as viewed in the drawing. As a result of this construction the filtering or dewatering pressure acting on the web W at the region of the shoe 25 continuously increases as the water content of the web W decreases. Moreover, the filtering or dewatering pressure acting on the web W at the region of the shoe 25 is at a minimum somewhat greater than the filtering or dewatering pressure at the region of the preceding dewatering means 24. It will be noted that a symmetrical dewatering action is enhanced by reason of the fact that the pair of dewaterng means 24 and 25 effect dewatering in mutually opposed directions.

Subsequent to the curved shoe 25 of the guide means, the web W travels between the pair of means 10 and 11 together with the latter along the common path of travel thereof which extends around the laps the reversing roll 27. It will be seen that the distance from the breast roll 16 to the startng location of the common path of travel of the pair of means 10 and 11 is substantially less than one half, and in fact only a relatively small fraction of, the distance from this starting location to the reversing roll 27. The wire or felt 10 laps the reversing roll 27 over an angular sector $\alpha$ which it will be seen is greater than 90°. At this sector $\alpha$ the interior of the reversing roll 27 is provided with a chamber 28 which is maintained at a pressure greater than atmospheric pressure, the outer wall or shell of the reversing roll 27 of course being formed with a number of apertures so that communication can be provided through these apertures with the chamber 28. However it is to be noted that the use of an overpressure chamber 28 is not absolutely essential. Thus, it is possible to provide by way of this latter chamber 28 a blowing zone which will promote dewatering over the angular sector $\alpha$ of the roll 27, with this latter blowing action augmenting the centrifugal dewatering which takes place at the part of the roll 27 which is lapped by the pair of means 10 and 11 as they continue to travel along their common path.

Inasmuch as the radius $R_2$ of the reversing roll 27 is considerably smaller than the mean radius of curvature $R_1$ of the shoe 25, and in fact smaller than smallest radius of curvature of the shoe 25, at the end of the latter which is nearest to the reversing roll 27, the web W will in cooperation with the reversing roll 27 be subjected to a higher centrifugal force than that prevailing at any part of the shoe 25 and therefore to a higher filtering or dewatering pressure than at the shoe 25. It is therefore, possible, in a simple and convenient manner, by suitable section of the radii $R_1$ and $R_2$ to achieve an optimum distribution of the filtering or dewatering pressure with minimum apparatus cost, and in fact the filtering or dewatering pressure at the reversing roll 27 can be increased by way of the overpressure chamber 28. It is thus possible to provide an arrangement according to which from the starting location of a common path of travel of the pair of means 10 and 11, this starting location being just beneath the reversing roll 17, through a substantial distance of the common path of travel, extending around the part of the reversing roll 27 lapped by the web-carrying means 10, the dewatering pressure acting on the web has a greater value as the distance from the starting location of the common path of travel increases, so that as the dewatering progresses the dewatering pressure increases.

Subsequent to the reversing roll 27, the web travels together with the pair of means 10 and 11, which continue to travel along their common path, into the region where the transfer means 29 acts. Thus at this region the suction box or set of boxes 29 will act to detach the web W from the wire or felt 11 and attach it reliably to the wire or felt 10 to be further transported by the latter to the drying section of the machine. Of course, instead of one or more section boxes it is possible to provide a transfer means in the form of a suitble suction roll.

As is apparent from the drawing, the wire or felt 10 changes its direction of travel by substantially 180° along the curved path extending from the lip slice of the headbox 12 to the transfer means 29. Of course a considerable part of this latter path taken by the wire or felt 10 is also taken by the wire or felt 11. In this way the length of the web forming section can be made relatively small and an efficient utilization of space is achieved. It is to be noted that this latter change in direction is primarily concentrated at the reversing roll 27, and of course as was pointed out above the angle $\alpha$ is greater than 90°.

Although only one embodiment of the invention has been described above, it will be understood that various equivalents are possible and that the invention is not confined in any way to the specific details shown in the drawing and described above.

What is claimed is:

1. In a machine for manufacturing paper such as tissue paper, a pair of elongated, flexible, endless, liquie-pervious means one of which is a web-carrying means and the other of which is a web-pressing means for coacting with said web-carrying means to compress a web, during formation thereof, between said pair of means, and guide means cooperating with said pair of means for guiding them for movement together along a predetermined common path of travel having a starting location at an early phase of web formation and an ending location where the web is in a condition, while compressed between and engaging both of said pair of means, to be detached from said web-pressing means while remaining in engagement with said web-carrying means and carried by said web-carring means beyond said web-pressing means with the web being compressed between said pair of means while travelling along said common path from said starting location to said ending location, said guide means cooperating with said pair of means for respectively guiding them for movement along separate paths respectively leading to said starting location and respectively travelling away from said ending location, said guide means including a breast roll cooperating with said web-carrying means and situated in advance of but adjacent to said starting location for guiding said web-carrying means toward said starting location, and said guide means cooperating with at least one of said pair of means for providing along said common path of travel through a substantial portion thereof beginning at said starting location a compressive pressure, acting on a web between said pair of means, which has progressively greater magnitudes at locations along said common path which are progressively more distant from said starting location, and headbox means situated at least in part over said breast roll and the part of said web-carrying means guided thereby for depositing on said web-carrying means at the region of said breast roll stock from which the web is formed so that the stock delivered from said headbox means is initially carried only by said web-carrying means from said breast roll toward said starting location without being compressed between said pair of means, and said guide means providing at the region of said starting location a compressive pressure greater than any dewatering pressure acting on the stock as it is carried by said web-carrying means from said breast roll to said starting location, whereby from said breast roll through said substantial portion of said common path beginning at said starting location the pressure acting to dewater the web during formation thereof increases as the extent of dewatering increases, said guide means including along said common path of travel, between and at a substantial distance from said starting and ending locations, a reversing roll for reversing the direction of trael of said pair of means, the distance of said breast roll to said starting location of said common path of travel being substantially less than one half the distance from said starting location along said common path of travel to said reversing roll, a stationary frame means carrying that part of said guide means which guides said web-carrying means with said reversing roll being situated at one end of said stationary frame means, and movable frame means carrying that part of said guide means which guides said web-pressing means, said movable frame means having a substantially U-shaped portion for receiving said reversing roll while situating said web-pressing means against said web-carrying means at said reversing roll as well as along portions of said web-carrying means extending from said reversing roll, said movable frame means having a pair of web-pressing reversing rolls respectively situated at said starting and ending locations of said common path for reversing the travel of said web-pressing means at said starting and ending locations, said movable frame means including a carriage means for displacing said movable frame means and all of the structure carried thereby in its entirety away from said stationary frame means.

2. In a machine for manufacturing paper such as tissue paper, a pair of elongated, flexible, endless, liquid-pervious means one of which is a web-carrying means and the other of which is a web-pressing means for coacting with said web-carrying means to compress a web, during formation thereof, between said pair of means, and guide means cooperating with said pair of means for guiding them for movement together along a predetermined common path of travel having a starting location at an early phase of web formation and an ending location where the web is in a condition, while compressed between and engaging both of said pair of means, to be detached from said web-pressing means while remaining in engagement with said web-carrying means and carried by said web-carrying means beyond said web-pressing means with the web being compressed between said pair of means while travelling along said common path from said starting location to said ending location, said guide means cooperating with said pair of means for respectively guiding them for movement along separate paths respectively leading to said starting location and respectively travelling away from said ending location, said guide means including a breast roll cooperating with said web-carrying means and situated in advance of but adjacent to said starting location for guiding said web-carrying means toward said starting location, and said guide means cooperating with at least one of said pair of means for providing along said common path of travel through a substantial portion thereof beginning at said starting location a compressive pressure, acting on a web between said pair of means, which has progressively greater magnitudes at locations along said common path which are progressively more distant from said starting location, and headbox means situated at least in part over said breast roll and the part of said web-carrying means guided thereby for depositing on said web-carrying means at the region of said breast roll stock from which the web is formed so that the stock delivered from said headbox means is initially carried only by said web-carring means from said breast roll toward said starting location without being compressed between said pair of means, and said guide means providing at the region of said starting location a compressive pressure greater than any dewatering pressure acting on the stock as it is carried by said web-carrying means from said breast roll to said starting location, whereby from said breast roll through said substantial portion of said common path beginning at said starting location the pressure acting to dewater the web during formation thereof increases as the extent of dewatering increases, said guide means including along said common path of travel a reversing roll for reversing the direction of travel of said pair of means between said starting and end locations, said guide means including between said starting location of said common path of travel and said reversing roll along said common path an elongated dewatering shoe havng an outwardly directed convexly curved surface engaging and pressing against said web-carrying means in advance of said reversing roll, with the latter also engaging said web-carrying means, said convexly curved surface having a curvature which progressively increases from an end of said curved surface which is nearest said starting location toward an end of said curved surface which is nearest said reversing roll and the latter having a radius smaller than the smallest radius of curvature of said curved surface, so that by way of the curvature of said curved surface and the radius of said reversing roll the dewatering pressure on a web between said pair of means progressively increases from said starting location at least up to and around that portion of said reversing roll which is lapped by said pair of means, said dewatering shoe having a closed convexly curved surface in engagement with said web-carrying means with dewatering taking place at said shoe by centrifugal force acting upwardly and outwardly away from said shoe through said web-pressing means, said reversng roll being lapped by said pair of means through an angle of greater than 90° with dewatering taking place also by centrifugal force at said reversing roll acting outwardly away from the latter through said web-pressing means at the portion of said reversing roll lapped by said pair of means, and said reversing roll having at said portion thereof a pressure chamber for directing air at greater than atmospheric pressure through the pair of means and the web compressed therebetween for augmenting the dewatering which takes place by centrifugal force at said reversing roll.

* * * * *